US007167667B2

(12) United States Patent
Mabuchi

(10) Patent No.: US 7,167,667 B2
(45) Date of Patent: Jan. 23, 2007

(54) DEVELOPING APPARATUS AND ELECTROSTATIC RECORDING APPARATUS USING THE SAME

(75) Inventor: Hiroyuki Mabuchi, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 189 days.

(21) Appl. No.: 10/991,100

(22) Filed: Nov. 18, 2004

(65) Prior Publication Data

US 2005/0123312 A1 Jun. 9, 2005

(30) Foreign Application Priority Data

Nov. 20, 2003 (JP) ..... P 2003-391312

(51) Int. Cl.
*G03G 15/08* (2006.01)

(52) U.S. Cl. ..... 399/255; 399/258

(58) Field of Classification Search ..... 399/30, 399/58, 61, 62, 63, 255, 256, 258, 259, 269
See application file for complete search history.

(56) References Cited

U.S. PATENT DOCUMENTS 4,173,405 A * 11/1979 Swapceinski et al. ..... 399/256
5,204,721 A * 4/1993 Sharpe ..... 399/256
5,495,320 A * 2/1996 Araki et al. ..... 399/256
5,659,859 A * 8/1997 Kikuta et al. ..... 399/256
5,722,002 A * 2/1998 Kikuta et al. ..... 399/30
5,724,635 A * 3/1998 Nagaoka et al. ..... 399/260

FOREIGN PATENT DOCUMENTS

| | | |
|---|---|---|
| JP | 5-107909 | 4/1993 |
| JP | 6-19300 | 1/1994 |
| JP | 6-167876 | 6/1994 |
| JP | 7-175309 | 7/1995 |
| JP | 2002-14533 | 1/2002 |

* cited by examiner

*Primary Examiner*—Robert Beatty
(74) *Attorney, Agent, or Firm*—McGinn IP Law Group, PLLC

(57) ABSTRACT

A developing apparatus characterized in being constituted to satisfy Equation (1) shown below when an amount of a developer carried by 1 pitch of a carrying member of an auger or the like is designated by notation W(g), a toner amount supplied by 1 pitch during a time period in which the developer carried by 1 pitch passes a supply region of a toner supply roller is designated by notation M(g), a toner concentration of the developer detected by a toner concentration sensor is designated by notation Tc (%), and a mixing limit toner concentration is designated by notation Tmax (%)

$$(W\times(Tc/100)+M)/(W+M)\leq Tmax/100. \quad (1)$$

4 Claims, 7 Drawing Sheets

FIG. 6

| |
|---|
| FIG. 6A |
| FIG. 6B |

FIG. 6A

| | | | EXAMPLE 1 | COMPARATIVE EXAMPLE 1 | EXAMPLE 2 | EXAMPLE 3 | EXAMPLE 4 |
|---|---|---|---|---|---|---|---|
| SUPPLY TONER FLOW RATE | – | g/s | 3.55 | 3.13 | 4.17 | 3.55 | 4.17 |
| MIXING LIMIT TONER CONCENTRATION | Tmax | % | 0.06 | 0.06 | 0.06 | 0.06 | 0.06 |
| TONER CONCENTRATION AFTER PASSING FEEDING PORTION (OUTLET PORTION OF AUGER 36b) | – | % | 0.06 | 0.07 | 0.06 | 0.06 | 0.06 |
| DETECTED TONER CONCENTRATION | Tc | rps | 0.04 | 0.04 | 0.04 | 0.04 | 0.04 |
| DEVELOPER AMOUNT PER BLOCK | W | g | 35.56 | 35.56 | 42.67 | 44.44 | 35.56 |
| TOTAL TONER AMOUNT SUPPLIED TO 1 BLOCK | M | g | 0.94 | 1.18 | 1.07 | 1.18 | 0.89 |
| TOTAL BLOCK NUMBER IN SUPPLY PORTION | N | piece | 22.50 | 22.50 | 18.75 | 22.50 | 22.50 |
| TIME REQUIRED FOR 1 SUPPLY OPERATION | Tf | s | 0.7 | 0.7 | 0.7 | 0.7 | 0.7 |

TO FIG. 6B

FIG. 6B

FROM FIG. 6A

| | | | | | | | |
|---|---|---|---|---|---|---|---|
| SUPPLY AMOUNT IN 1 SUPPLY OPERATION | Mf | g | 1.1 | 1.1 | 1.25 | 1.1 | 1.25 |
| TOTAL SUPPLY AMOUNT IN PASSING SUPPLY PORTION | Mt | g | 21.22 | 26.52 | 20.10 | 26.52 | 20.09 |
| SUPPLY PORTION PASSING TIME | T | s | 13.51 | 16.88 | 11.25 | 16.88 | 11.25 |
| DEVELOPER FEEDING SPEED | V | mm/s | 33.32 | 26.66 | 39.98 | 26.66 | 40.00 |
| PAUSE TIME | Tint | s | 0.2 | 0.2 | 0.2 | 0.2 | 0.2 |
| SUPPLY TIME | Tr | s | 0.5 | 0.5 | 0.5 | 0.5 | 0.5 |
| FEED ROLL ROTATIONAL NUMBER | Rr | rps | 1 | 1 | 1 | 1 | 1 |
| SUPPLY AMOUNT PER ROTATION | Ma | g | 2.2 | 2.2 | 2.5 | 2.2 | 2.5 |
| AUGER PITCH | P | mm | 20 | 20 | 24 | 20 | 20 |
| AUGER PORTION DEVELOPER AMOUNT | Wt | g | 800 | 800 | 800 | 1000 | 800 |
| SUPPLY WIDTH | L | mm | 450 | 450 | 450 | 450 | 450 |
| AUGER ROTATIONAL NUMBER | R | rps | 1.67 | 1.33 | 1.67 | 1.33 | 2.00 |

FIG. 7

| SUPPLY MODE | CONTENT OF 1 SUPPLY OPERATION TIME | | AUGER ROTATIONAL NUMBER |
|---|---|---|---|
| | SUPPPLY TIME | PAUSE TIME | |
| | (s) | (s) | (s−1) |
| 1 | 0.5 | 10 | 1.333 |
| 2 | 0.5 | 5 | 1.333 |
| 3 | 0.5 | 3 | 1.333 |
| 4 | 0.5 | 1 | 1.333 |
| 5 | 0.5 | 0.5 | 1.333 |
| 6 | 0.5 | 0.2 | 1.333 |
| 7 | 0.5 | 0.2 | 1.666 |

DEVELOPING APPARATUS AND ELECTROSTATIC RECORDING APPARATUS USING THE SAME

BACKGROUND OF THE INVENTION

1. Field of the Invention

The present invention relates to an electrostatic recording apparatus of a printer, a copier or the like using an electrophotography system, particularly relates to a developing apparatus using a two components developer and an electrostatic recording apparatus using the same.

2. Description of the Related Art

FIG. 8 is an outline view of an electrostatic recording apparatus of an electrophotography system using a developing apparatus of a background art. A developing apparatus 4 includes two developing rollers 31*a*, 31*b* at positions opposed to a photosensitive member 1, a carry roller 35 for carrying a developer which is a mixture of a toner 21 and a carrier to the developing rollers 31*b*, and a carrying amount restricting member 33 for restricting an amount of carrying the developer to a predetermined amount.

An electrostatic latent image formed on the photosensitive member 1 by charging uniformly using a charging apparatus 2 and thereafter exposed in accordance with image information by an exposing apparatus 3 is devloped by the developer on the developing rollers 31*a*, 31*b* at a developing region 40*a*, 40*b* to thereby adhere the toner 21 to.

The developing apparatus having a constitution in which the developing rollers 31*a*, 31*b* are opposed to each other by interposing the carrying amount restricting member 33 as shown by FIG. 8 is generally referred to as a center feed type developing apparatus and is known as a developing system capable of achieving high print quality by a printing apparatus of an electrostatic recording system having a fast printing speed.

Successively, the toner 21 on the photosensitive member 1 is transferred onto a record medium 8 by forming an electric field in a direction of moving the toner 21 to the record medium 8 by a transferring apparatus 7. The record medium 8 adhered with the toner 21 is applied with heat and pressure in passing a fixing apparatus 9, and the toner 21 is melted to fixedly attach to fix to the record medium 8.

An adhered toner 21 or a paper powder or the like remaining on the photosensitive member 1 after passing the transferring portion is removed from the photosensitive member 1 by a cleaning apparatus 11.

Next, operation of the developing apparatus 4 will be explained. Inside of the developing apparatus 4 is arranged with two pieces of the developing rollers 31*a* and 31*b* having rotatable sleeve rollers 32*a*, 32*b* at outer peripheries of fixed magnets 30*a*, 30*b* to be opposed to each other by interposing the carrying amount restricting member 33.

According to the developing roller 31*a*, the sleeve roller 32*a* is rotated in the clockwise direction, that is, such that the developer is rotated in a direction inverse to a direction of rotating the photosensitive member 1 at a developing region 40*a* (hereinafter, referred to as inverse rotation).

According to the developing roller 31*b*, the sleeve roller 32*b* is rotated in the counterclockwise direction, that is, such that the developer is rotated in a direction the same as the direction of rotating the photosensitive member 1 in a developing region 40*b* (hereinafter, referred to as regular rotation).

A vicinity of the developing roller 31*b* is provided with the carry roller 35 constituted by a fixed magnet and a sleeve roller arranged rotatably at an outer periphery thereof similar to the developing roller for carrying the developer to the developing roller 31*b*.

Further, an agitating mechanism portion 34 surrounded by a broken line is arranged with two augers 36*a*, 36*b* by providing intervals between outer peripheries of the augers and a bottom portion and a side portion of the developing apparatus 4, and a toner concentration sensor 45 is arranged such that a detecting face thereof is brought into contact with the developer accumulated at a lower portion of the auger 36*b* at the bottom portion of the developing apparatus on a lower side of the auger 36*b*.

A partition wall 41*a* is projected from a lower portion of the developing apparatus between the two augers 36*a* and 36*b*, and a partition wall 41*b* is projected also between the auger 36*a* and the carry roller 35, to form a region of accumulating the developer at lower regions of the respective augers. A partition plate 37 is provided between the two augers 36*a*, 36*b*.

An upper side of the agitating mechanism portion 34 is provided with a toner hopper 39 charged with the toner 21 at inside thereof, and a supply roller 38 for supplying the charged toner 21 into an agitating chamber.

The agitating mechanism portion 34 agitates the developer while moving the developer in a front and rear direction relative to a face of the drawing by rotating the augers 36*a*, 36*b*. According to the example, the auger 36*a* is rotated in the clockwise direction to carry the developer to a depth side of the drawing, the developer is made to flow to a side of the auger 36*b* at a machine end of the developing apparatus not illustrated, and the auger 36*b* is rotated in the counter clockwise direction to carry the developer to a front side.

At this occasion, since the partition wall 41*a* is projected from below to between the augers 36*a*, 36*b*, and lower portions of surroundings of the augers 36*a*, 36*b* are surrounded by the partition walls 41 and the bottom portion of the developing apparatus, the developer accumulated at the region is pressed in an axial direction and a rotational direction by feeding blades of the augers 36*a*, 36*b*, the auger 36*a* carries the accumulated developer to the depth side of drawing while moving the developer in a direction of the carry roller 35, and the auger 36*b* carries the developer to the front side while moving the developer to a left side of drawing.

Therefore, the auger 36*a* carries the developer to the depth side of drawing while moving the developer in the direction of the partition wall 41*b* and in the carrying procedure, the developer moved in the direction of the carry roller 35 by a magnetic force of the carry roller 35 is adsorbed to the carry roller 35.

The developer adsorbed by the carry roller 35 is carried to a vicinity of the developing roller 31*b* by rotating the sleeve roller, magnetically adsorbed to a surface of the sleeve roller 32*b* by a magnetic force of N1 pole of the magnet 30*b* at inside of the developing roller 31*b*, and is carried to S1 pole by rotating the sleeve roller 32*b*. The carrying amount restricting member 33 is arranged by adjusting an interval from the sleeve roller 32*b*, an amount of carrying the carried developer is restricted by the interval between the carrying amount restricting member 33 and the sleeve roller 32*b* (hereinafter, referred to as doctor gap) by rotating the sleeve roller 32*b*, and a constant amount of the developer passing the carrying amount restricting member 33 reaches the developing region 40*b*.

Here, the developer is erected by a magnetic field formed by N2 pole and a magnetic pole at a surrounding thereof to slide to abrade the photosensitive member 1. The doctor gap is set to constitute a proper value of a carrying amount relative to a developing gap so as not to disturb a developed image by excessively abrading the photosensitive member 1 by the developer, or to achieve a sufficient printing concentration because the carrying amount is small relative to the interval between the photosensitive member 1 and the sleeve roller 32 (hereinafter, referred to as developing gap).

The developer which cannot pass the doctor gap at the carrying amount restricting member 33 rides over the carrying amount restricting member 33 to be carried to the developing roller 31*a* and is carried to the developing region 40*a* by restricting the carrying amount to be constant by the interval between the carrying amount restricting member 33 and the sleeve roller 32*a*. The developer which cannot pass the doctor gap is returned to the agitating mechanism portion 34 by a carrying guide 50.

The developer carried to the developing region 40*b* by the sleeve roller 32*b* to finish developing is carried by rotating the sleeve roller 32*b* to return to the carry roller 35. Further, the developer carried to the developing region 40*a* by the sleeve roller 32*a* to finish developing is carried by rotating the sleeve roller 32*a* to return to the agitating mechanism portion 34 by the carrying guide 50.

In this way, according to the developing apparatus of the center feed system, two developing rollers 31*a*, 31*b* interposing the carrying amount restricting member 33 carry the developer in directions inverse to each other and therefore, a flow of the developer is divided in two. That is, there are a flow of returning from the developing roller 31*a* to the agitating mechanism portion 34 to direct to a side of the carrying amount restricting member 33 by way of the carry roller 35 and a flow directed from the developing roller 31*b* to a side of the carrying amount restricting member 33 by way of the carry roller 35. The two flows merge at the carry roller 35, and are mixed to carry to feed to the side of the carrying amount restricting member 33.

The toner concentration sensor 45 provided at inside of the agitating mechanism portion 34 always detects a toner concentration value of the developer carried by the auger 36*b* and compares a detected value thereof with a reference value when the developer having a rectified toner concentration is carried at a toner concentration control circuit, not illustrated. When the toner concentration is detected to be low, the toner 21 is supplied to the agitating mechanism portion 34 from the toner hopper 39 by rotating the supply roller 38 to agitate to mix with the developer by rotating the auger 36*b*.

When the detected value of the toner concentration sensor 45 reaches the specified toner concentration by supplying the toner, supply of the toner 21 is stopped. When the toner concentration does not reach the specified value, the toner 21 is further supplied repeatedly until the toner concentration reaches the specified value.

The supplied toner is agitated while being carried to the front side of the drawing by rotating the auger 36*b* to be conveyed to the auger 36*a* at an end portion on the front side while being frictionally charged along with a carrier to be conveyed again to the carry roller 35 while being carried to the depth side of the drawing to circulate at inside thereof in the developing operation to thereby relate to development.

This kind of the developing apparatus is described in, for example, JP-A-5-107909, JP-A-6-167876, JP-A-6-019300, JP-A-7-175309 and JP-A-2002-14533.

In the recording apparatus of the electrostatic recording system for carrying out printing by the above-described process, there is needed development of a small-sized low cost developing system capable of carrying out printing having a high resolution without being adhered with the carrier at a high printing density also on a sheet having a wide width at high speed.

In order to meet such a purpose, there are many examples of adopting the developing apparatus of the center feed system since high image quality printing can easily be carried out, however, as described above, according to the developing apparatus of the center feed system, the flow of the developer at inside of the apparatus is divided in two and therefore, an amount of the developer returned to the agitating mechanism portion 34 after development frequently constitutes a portion of a total thereof.

Although the concentration of the developer returned to the agitating mechanism portion 34 is detected by the toner concentration sensor 45 and when the concentration is lower than the reference value, the concentration is returned to the reference value by supplying the toner 21, a flow of the developer merges with the flow which does not detour the agitating mechanism portion 34 at the carry roller 35, that is, the flow of the developer the concentration of which becomes low without supplying the toner 21 after consuming the toner to mix with each other and therefore, in order to make the toner concentration at a time point of reaching the carrying amount restricting member 33 coincide with the reference value, it is necessary to supply the toner amount to the developer including an amount thereof which is consumed by the flow in which the toner 21 is not supplied.

Further, according to the developing apparatus having members of carrying the developer in axial directions of augers 36*a*, 36*b* or the like, there is repeated operation of returning the developer consuming the toner 21 by the developing rollers 31*a*, 31*b* to the augers 36*a*, 36*b*, kneading the developer with the developer carried by the augers 36*b* and thereafter carrying to the developing rollers 31*a*, 31*b* again to consume the toner 21 and therefore, the toner concentration is significantly lowered on the downstream side in the feeding direction and a large amount of the toner 21 is supplied during a time period of passing the toner supply portion in order to recover the toner concentration of the developer having the considerably lowered toner concentration to the reference toner concentration.

The higher the printing density (printing area per unit area), the wider the printing width and the larger the toner amount consumed at the developing region during a time period by which the developer is moved by a unit length in the axial direction by the fast printing speed, the more significant the inclination of the toner concentration in the axial direction appears.

Although in the developing apparatus 4, the toner 21 supplied from the toner hopper 39 is normally diffused to mix with the developer swiftly by rotating the auger 36*b*. According to an investigation by the inventors, it has been found that there is a limit in the toner concentration capable of diffusing to mix the supplied toner 21 to inside to the developer to charge the carrier and the toner 21, that is, a mixing rate (hereinafter, referred to as mixing limit toner concentration), and even when the toner exceeding the mixing limit toner concentration is supplied, the toner 21 cannot be brought into the developer and the toner 21 is separated to float on a surface of the developer.

When the floating toner 21 reaches the developing portion by riding on the flow of the developer, the toner 21 stains a printed image as fogging to a background portion, or stains inside of the recording apparatus by being scattered from an opening portion of the developing apparatus to outside of the apparatus.

As a method of preventing the phenomenon, there are known various constitutions of adding the partition plate 37 a lower end of which is disposed on a lower side of the surface of the developer on the side of the developing rollers of the augers 36*b* supplied with the toner (refer to FIG. 8), and rotating the augers 36*a*, 36*b* in rotational directions in directions of storing the developer between the two augers in the constitution of using two pieces of the augers 36*a*, 36*b*. However, the once floating toner 21 cannot be brought into the developer and therefore, the stored floating toner flows out from the agitating mechanism portion to be blown out to outside of the developing apparatus at a certain time point.

There are JP-A-5-107909, JP-A-6-167876, JP-A-6-019300, JP-A-7-175309, mentioned above, as inventions for promoting an agitating function, when the augers or the like having the high agitating function are used, although the toner 21 can temporarily be mixed into the developer, when the toner concentration of the agitating mechanism portion 34 exceeds the mixing limit toner concentration, there is a case in which even when the mixing is carried out as much as possible, the toner 21 exceeding an amount of capable of being held in the developer is floated in the procedure of carrying the toner 21 and therefore, a drawback of scattering the toner is rather promoted.

As the invention of controlling the developer carried from the agitating mechanism portion 34 not to exceed a reference toner concentration value, JP-A-2002-14533, mentioned above, discloses a method for providing two pieces of toner concentration sensors on an upstream side and a downstream side of an agitating mechanism portion and changing a toner supply amount by detected values of the two sensors.

However, according to the system, the system of the prior art of comparing an output value of a single toner concentration sensor with a reference toner concentration value and changing a toner amount to be supplied by a difference therebetween is added with an effect of correcting a supply amount when the supply amount is varied from an inherent supply amount, and there is not sufficiently resolved the problem that when a large amount of the toner is consumed in the developing apparatus having the flow which does not pass through the agitating mechanism portion in the developing apparatus, in order to recover the toner concentration to the reference value, a large amount of the toner is supplied to the developer passing the agitating mechanism portion to bring about the drawback of scattering the toner or the like.

SUMMARY OF THE INVENTION

The present invention has been made in view of the above circumstances.

According to a first aspect of the invention, a developing apparatus includes a supply roller supplying a toner; an agitating mechanism portion which is supplied with the toner from the supply roller and includes a carrying member agitating to mix a developer and the toner while carrying the developer in an axial direction of the agitating mechanism portion; and a toner concentration sensor detecting a concentration of the toner in the developer. The supply roller and the carrying member are arranged substantially in parallel with each other, and a flow of the developer includes a flow of passing the agitating mechanism portion and a flow which does not pass the agitating mechanism portion, and the developing apparatus are satisfactory with the following equation.

$$(W\times(Tc/100)+M)/(W+M)\leqq T\max/100$$

W is an amount of the developer carried by 1 pitch of the carrying member; M is an amount of the toner supplied by 1 pitch of the carrying member during a time period in which the developer carried by 1 pitch passes a supply region by the supply roller; Tc is a concentration of the toner in the developer detected by the toner concentration sensor; and Tmax is a mixing limit toner concentration.

According to a second aspect of the invention, in the developing apparatus, at least one of an amount of supplying the toner and a speed of carrying the developer by the carrying member can be changed in accordance with a detected value of the toner concentration sensor.

According to a third aspect of the invention, the developing apparatus further includes a first developing roller disposed upstream in a direction of rotating a photosensitive member and carrying the developer in an opposite direction of rotating the photosensitive member; and a second developing roller disposed downstream in the direction of rotating the photosensitive member and carrying the developer in the direction of rotating the photosensitive member. The flow of the developer passing the agitating mechanism portion is formed by the first developing roller, the flow of the developer which does not pass the agitating mechanism portion is formed by the second developing roller, and the developer is carried to between the first developing roller and the second developing roller.

According to a fourth aspect of the invention, an electrostatic recording apparatus includes a photosensitive member; a charging unit charging a surface of the photosensitive member; an exposing unit exposing the surface of the photosensitive body to form an electrostatic latent image in accordance with an image information; a developing unit developing the electrostatic latent image with a toner to form a toner image on the surface of the photosensitive member; and a transferring unit transferring the toner image to a transferred member. The developing unit includes a supply roller supplying a toner; an agitating mechanism portion which is supplied with the toner from the supply roller and includes a carrying member agitating to mix a developer and the toner while carrying the developer in an axial direction of the agitating mechanism portion; and a toner concentration sensor detecting a concentration of the toner in the developer. The supply roller and the carrying member are arranged substantially in parallel with each other, and a flow of the developer includes a flow of passing the agitating mechanism portion and a flow which does not pass the agitating mechanism portion; and the developing apparatus are satisfactory with the following equation.

$$(W\times(Tc/100)+M)/(W+M)\leqq T\max/100$$

W is an amount of the developer carried by 1 pitch of the carrying member; M is an amount of the toner supplied by 1 pitch of the carrying member during a time period in which the developer carried by 1 pitch passes a supply region by the supply roller; Tc is a concentration of the toner in the developer detected by the toner concentration sensor; and Tmax is a mixing limit toner concentration.

In the invention, the concentration of the toner of the developing apparatus using a two components developer can be controlled to a specified value and therefore, there can be provided a small-sized low cost developing apparatus without a drawback that when the toner is supplied, the concentration of the toner of the developer passing the supply portion becomes excessive to scatter the toner from the developing apparatus, or fogging is brought about in a printed image, and capable of dealing with a condition of a large amount of consuming the toner when a print width is wide, when a printing speed is fast, or when a density of the printed image is high.

Particularly in a developing apparatus having a constitution in which a flow of a developer is branched into two or more at inside of a developing apparatus of a center feed type developing apparatus or the like, only a portion of the developer a toner of which is consumed at a developing portion passes a toner supply portion, there can be provided an electrostatic recording apparatus capable of significantly promoting stability of the concentration of the toner and having a high printing quality.

BRIEF DESCRIPTION OF THE DRAWINGS

FIG. 6 is a diagram showing conditions of agitating mechanism portions of embodiments of the invention and a comparative example.

FIG. 7 is a diagram showing a toner supply mode applied in Example 4 of the invention.

DETAILED DESCRIPTION OF THE PREFFERED EMBODIMENTS

Figure 1:
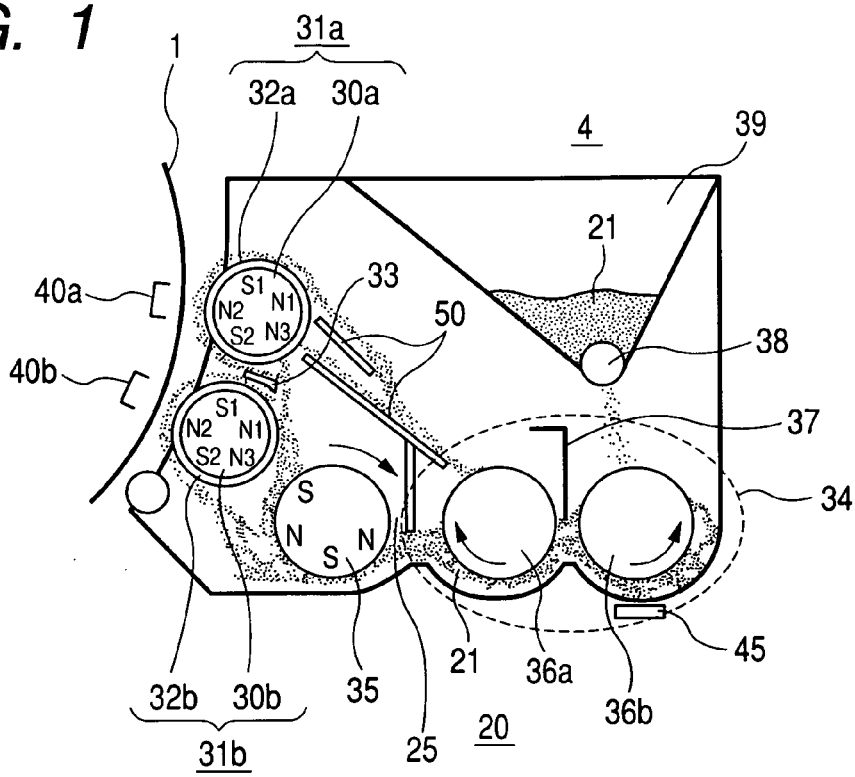
FIG. 1 is an outline constitution view of a developing apparatus used in one embodiment of the invention.

A detailed explanation will be given of an embodiment of the invention in reference to the drawings as follows. FIG. 1 is an outline constitution view of a developing apparatus according to the embodiment of the invention, and FIG. 2 is an outline constitution view enlarging an agitating mechanism portion at inside of the developing apparatus.

According to the agitating mechanism portion 34, two pieces of the augers 36*a*, 36*b* are arranged at pertinent intervals from the bottom portion and the side portion of the developing apparatus 4. The lower portion of the auger 36*b* is arranged with the detecting face of the toner concentration sensor 45 such that the detecting face of the toner concentration sensor 45 is brought into contact with the developer accumulated at the lower portion of the auger 36*b*.

Figure 2:
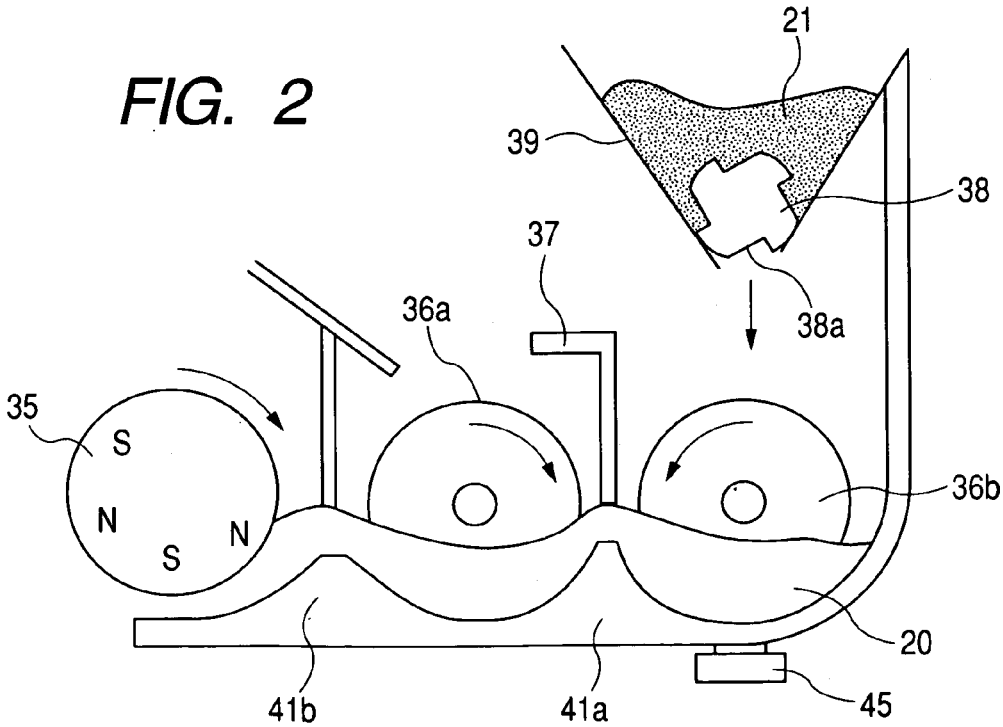
FIG. 2 is an enlarged side view showing an outline constitution of an agitating mechanism portion used in the developing apparatus.

As shown by FIG. 2, the partition wall 41*a* is projected from the lower portion of the developing apparatus 4 between the two augers 36*a*, 36*b*. Further, the partition wall 41*b* is projected also between the auger 36*a* and the carry roller 35 on the left side of the auger 36*a* to thereby form the region of accumulating the developer 20 at the regions on the lower sides of the respective augers. Further, the partition plate 37 is provided between the two augers 36*a*, 36*b*.

Figure 3:
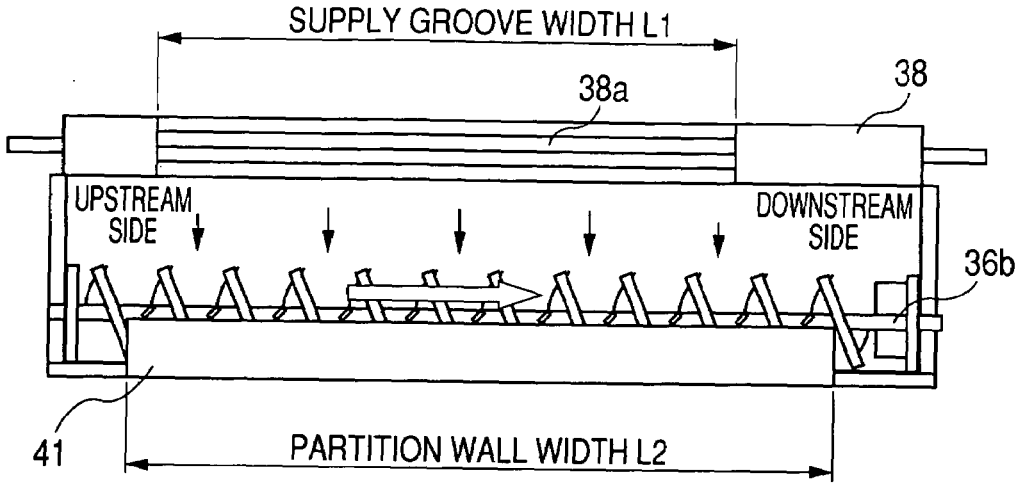
FIG. 3 is a front view showing an outline constitution of the agitating mechanism portion.

An upper side of the agitating mechanism portion 34 is provided with the toner hopper 39 charged with the toner 21 at inside thereof, and the supply roller 38 for supplying the charged toner 21 into the agitating chamber. As shown by FIG. 3, the supply roller 38 is provided with a groove 38*a* in an axial direction of an outer peripheral face thereof, and the toner 21 accumulated in the groove 38*a* is dropped onto the auger 36*b* by rotating the supply roller 38 to thereby supply the toner 21.

Although a width L1 of the groove 38*a* for supply may be constituted by a length equivalent to a width of the agitating mechanism portion 34, it is preferable that the width L1 is made to be shorter than a width L2 of the partition walls 41 such that the supply is not carried out to a region of both end portions in the axial direction at which the partition walls 41 are not present (refer to FIG. 3). Further, it is preferable to widely constitute a region at which supply is not carried out up to an upstream side of a notched portion (end portion) of the partition wall 41 on the downstream side of the auger 36*b* such that the supplied toner 21 is mixed and agitated with the developer 20 and thereafter carried to a side of the auger 36*a*.

At the agitating mechanism portion 34, the developer is agitated while moving the developer in a front and rear direction of FIG. 1 by rotating the augers 36*a*, 36*b*. According to the embodiment, as shown by FIG. 2, the auger 36*a* carries the developer 20 to the depth side of the drawing by being rotated in the clockwise direction, the developer 20 is made to flow to a side of the auger 36*b* at an end portion of the developing apparatus, not illustrated, and the auger 36*b* carries the developer 20 to the front side by being rotated in the counterclockwise direction.

In this case, the partition wall 41*a* is projected from below to between the augers 36*a*, 36*b*, lower portions of surroundings of the augers 36*a*, 36*b* are surrounded by the partition walls 41 and the bottom portion of the developing apparatus and therefore, the developer 20 accumulated at the region is pressed in an axial direction and a rotational direction by a winding direction and a rotational direction of a feeding blade of the augers 36*a*, 36*b*, at the auger 36*a*, the accumulated developer 20 is carried to the depth side of the drawing while moving in a direction of extruding the developer 20 in directions of the carry rollers 50 and at the auger 36*b*, the developer 20 is carried to the front side while being moved to the left side of the drawing. Therefore, the auger 36*a* carries the developer 20 to the depth side of the drawing while moving the developer 20 in a direction of the partition wall 41*b*, and the developer is adsorbed to the carry roller 35 by the magnetic force of the carry roller 35 in the carrying procedure to be carried in a direction of the developing rollers 31.

The toner concentration sensor 45 detects a toner concentration value of the developer 20 carried by the auger 36*b*, the detected value is compared with a reference value when the developer having a rectified toner concentration is carried at a toner concentration control circuit, not illustrated. When the toner concentration is determined to be low, the toner 21 is supplied to the agitating mechanism portion 34 from the toner hopper 39 by rotating the supply roller 38 for a rectified period of time by instruction from the toner concentration control circuit.

According to the embodiment, the supply roller 38 is rotated by a supply time period of Tr(s) and thereafter paused by Tint(s), and when the toner concentration calculated from the detected value of the toner concentration sensor 45 does not become higher than the reference value, the roller 38 is repeatedly rotated to supply by Tr(s) and pause by Tint(s) to thereby control the detected toner concentration to become the specified value. That is, one time supply operation is carried out by a supply time period of Tf=Tr+Tint. During the supply time period, the toner 21 of Mt(g) is supplied to the auger 36*b* from a supply width of L1(mm) of the supply roller 38.

Figure 4:
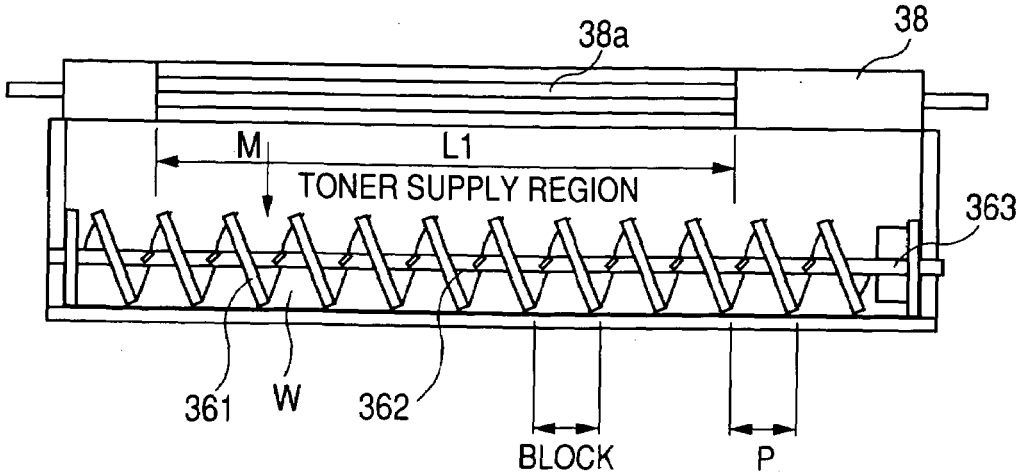
FIG. 4 is a front view showing the outline constitution of the agitating mechanism portion.

FIG. 4 is an outline constitution view showing the auger 36*b* used in the embodiment. A shaft 363 is provided with a feeding blade 361 in a spiral shape, and provided with projected portions 362 functioning to move the developer 20 in a direction of rotating the auger at intervals of an auger pitch (P) which is a distance in an axial direction of an amount of one rotation of the feeing blade at portions of shaft portions at which the feeding blades 361 are not present (middle portions interposed by portions of the feeding blade 361).

Here, when the developer 20 consuming the toner 21 by development is supplied with the toner 21 carried to the toner supply portion to maintain the toner concentration of the developer 20 at inside of the developing apparatus 4 at a constant value, the invention is constituted to satisfy following Equation (1), in the case in which a distance of moving the developer 20 by one rotation of the auger 36*b* (=auger pitch P) is defined as 1 block, when a toner amount supplied to the 1 block during a time period in which a developer amount W(g) disposed in 1 block passes the supply width L1 of the supply roller 38 by rotating the auger 36*b* in the toner supply operation is designated by notation M(g), the detected toner concentration by the toner concentration sensor 45 is designated by notation Tc(%), and the mixing limit toner concentration is designated by notation Tmax(%) such that the toner concentration of the developer 20 supplied with the toner 21 does not become excessive.

$$(W\times(Tc/100)+M)/(W+M)\leqq Tmax/100 \quad (1)$$

Specifically, the developer amount W (g) present in 1 block is calculated as follows.

$$W=Wt/N \quad (2)$$

where

Wt: a developer amount (g) disposed at the toner supply region of the auger 36*b* (here, the supply region indicates a region at which the toner is supplied from the toner supply portion at the auger portion)

N: number of blocks in a feeding direction of the toner supply portion, here, $$N=L/P \quad (3)$$

where

L: toner supply portion feeding direction width (mm) [=feed roller groove length]

P: auger pitch (mm)

Wt is calculated by measuring an amount of the developer 20 stored at the portion of the auger 36*b* of the developing apparatus 4 which is stopped after carrying out developing operation.

Further, the toner amount M(g) supplied during a time period of passing the supply portion by rotating the auger 36*b* in the toner supply operation is represented by Equation (4) as follows.

$$M=Mt/N \quad (4)$$

where

Mt: total toner amount (g) supplied to the supply region in passing the feeding portion, here, $$Mt=T\times Mf/Tf \quad (5)$$

where

T: feeding portion passing time period of 1 block (s)

Tf: supply operation time period per one supply order (s)

Mf: supply toner amount per one supply order (g)

The feeding portion passing time period T of 1 block, the supply operation time period per one supply order Tf, and the supply toner amount per one supply order Mf are respectively represented by Equations (6), (7), (8) as follows.

$$T=L/V \quad (6)$$

where

V: feeding speed (mm/s)

$$V=R\times P \text{ (mm/s)}$$

R: rotational number of the auger 36*b* ($s^{-1}$)

$$Tf=Tr+Tint \quad (7)$$

where

Tr: toner supply operation time period during 1 supply operation time period (s)

Tint: pause time period (s)

$$Mf=Rr\times Tr\times Ma \quad (8)$$

where

Rr: supply roller rotational number ($s^{-1}$)

Ma: toner supply amount per one rotation of supply roller (g)

Further, measurement of the mixing limit toner concentration (Tmax) is carried out by agitating a developer prepared by putting a carrier of 25 g and a toner into a vessel made of a synthetic resin in a shape of a bin of 100 cc to constitute a predetermined toner concentration at 42 $min^{-1}$ for 5 minutes by a turbulent mixer (made by WAB K.K.), tapping the developer for 30 s by a powder tester (Hosokawa Micron K.K.) and observing a surface state of the developer.

The above-described evaluation is carried out by developers having different toner concentrations, and a toner concentration by which a surface of the developer is brought into a state of being covered by the floating toner is defined as a limit toner concentration.

Figure 5:
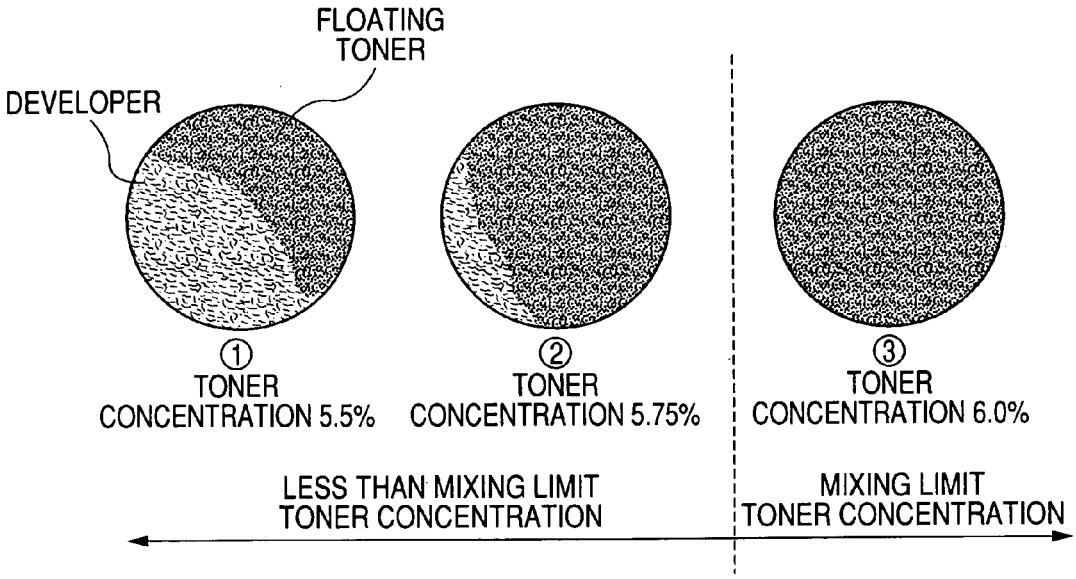
FIG. 5 is a view for explaining a mixing limit toner concentration.
Figure 8:
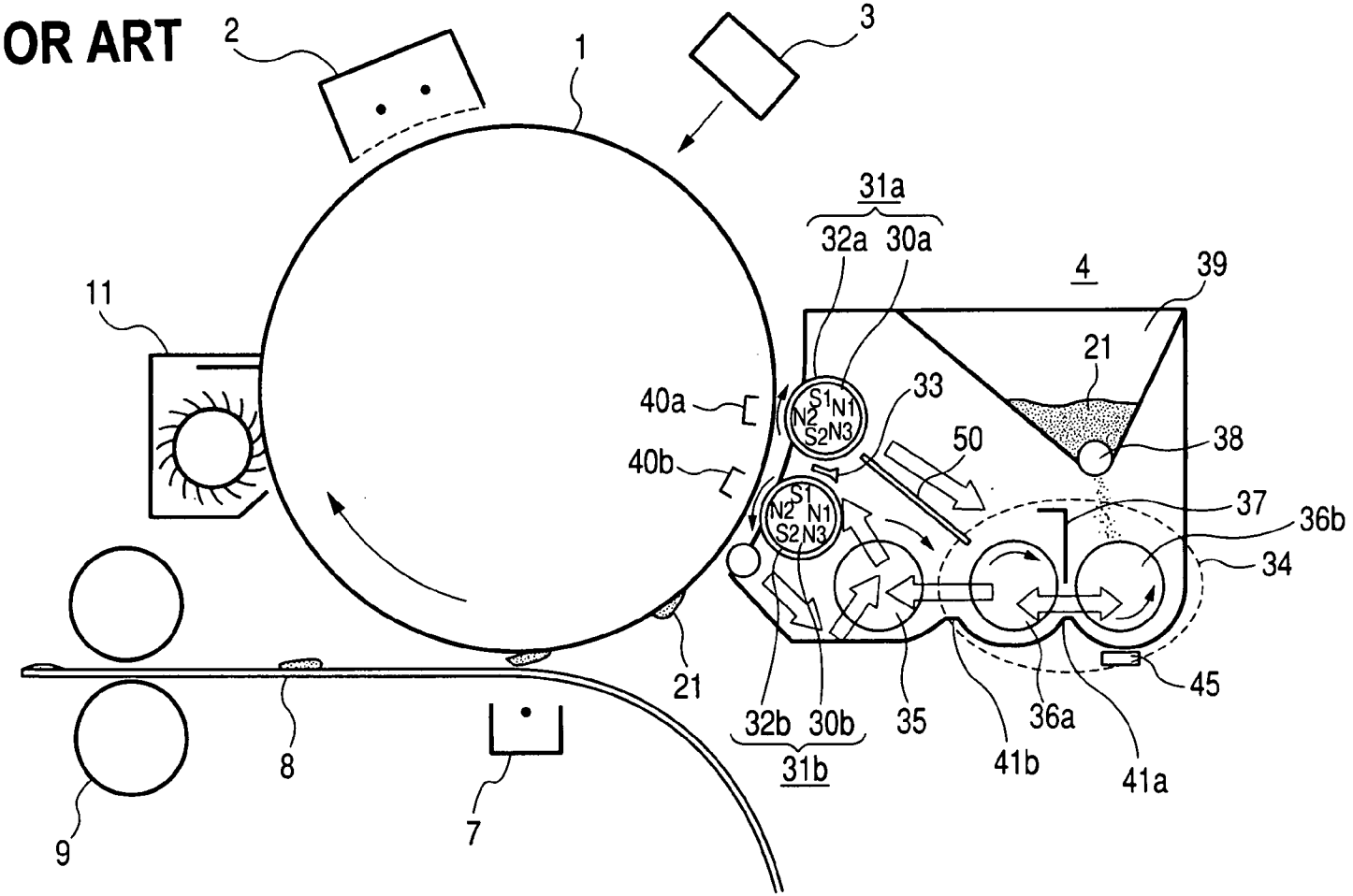
FIG. 8 PRIOR ART
FIG. 8 is an outline constitution view of an electrostatic recording apparatus using a developing apparatus of a prior art.

FIG. 5 is a view for explaining an example of determining a surface state of a developer in measuring the mixing limit toner concentration (Tmax). The measurement is carried out by a developer increasing a toner concentration by each 0.25% from a toner concentration by which a toner is mixed therewith without a problem. The drawing schematically shows a surface state observed from an upper face of the above-described bin-shaped vessel.

As shown by the drawing, although at toner concentrations of 5.5% and 5.75%, the toner is floated on the surface of the developer, the toner does not reach a state of covering a total of the surface and the state corresponds to smaller concentration than the mixing limit toner concentration. At toner concentration of 6.0% constituted by increasing the toner concentration further, the surface of the developer is brought into a state of being completely covered with the floating toner. Therefore, according to the developer, the mixing limit toner concentration is determined to be 6.0%.

An explanation will be given of the invention by using specific examples as follows.

EXAMPLE 1

As shown by FIG. 1, inside of the developing apparatus 4 is arranged with two pieces of the developing rollers 31*a*, 31*b* having a diameter of 50 mm and thermally sprayed with SUS at a surface thereof having the rotatable sleeve rollers 32*a*, 32*b* at the outer peripheries of the fixed magnets 30*a*, 30*b* by interposing the carrying amount restricting member 33 therebetween.

At the developing roller 31*a* arranged on the upstream side in the rotational direction of the photosensitive member 1, the sleeve roller 32*a* is rotated in the clockwise direction, that is, the developer 20 is inversely rotated at the developing region 40*a*, and at the developing roller 31*b* arranged on the downstream side of the rotational direction of the photosensitive member 1, the sleeve roller 32*b* is rotated in the counterclockwise direction, that is, rotated regularly at the developing region 40*b*.

A vicinity of the developing roller 31*b* is arranged with the carry roller 35 having a diameter of 50 mm constituted by the magnet fixed similar to the developing roller 31*b* and the sleeve roller rotatably arranged at the outer periphery for carrying the developer 20 to the developing roller 31*b*.

The developer 20 finished with developing at the developing roller 31*a* is returned to the agitating mechanism portion 34 to mix with the supplied toner 21 and carried to the carry roller 35, and the developer 20 finished with developing at the developing roller 31*a* merges with the developer 20 carried from the agitating mechanism portion 34 at the carry roller 35 and is again carried to the carrying amount restricting member 33.

At the agitating mechanism portion 34, two pieces of the augers 36*a*, 36*b* having an outer diameter of 40 mm are arranged by spacing apart outer peripheries thereof from the bottom portion and the side portion of the developing apparatus 4 by pertinent intervals, and the lower portion of the auger 36*b* is arranged with the toner concentration sensor 45 of a permeability detecting type such that the detecting face is brought into contact with the developer accumulated at the lower portion of the auger 36*b*.

The partition wall 41*a* is projected from below to between the two augers 36*a*, 36*b*, the partition wall 41*b* is projected also to between the auger 36*a* and the carry roller 35 to thereby form the region of accumulating the developer 20 at the lower regions of the two augers 36*a*, 36*b*. Further, the partition plate 37 is provided between the two augers 36*a*, 36*b*.

An upper side of the agitating mechanism portion 34 is provided with the toner hopper 39 charged with the toner 21 at inside thereof, and the supply roller 38 for supplying the charged toner 21 into the agitating chamber. At the supply roller 38, the grooves 38*a* are arranged at 8 portions thereof in the axial direction of the outer peripheral face, the supply width L1 is set to 450 (mm), the toner amount per 1 rotation Ma is set to 2.2 (g), and the rotation number Rr of the supply roller 38 is set to 1 ($s^{-1}$).

The toner 21 is supplied by dropping the toner 21 stored in the groove 38*a* onto the auger 36*b* by rotating the supply roller 38. Although the supply width L1 (mm) which is the length in the axial direction of the groove 38*a* may be a length equivalent to the width of the agitating mechanism portion 34, as shown by FIG. 3, it is preferable that the width L1 is shorter than the width L2 of the partition walls 41 such that supply is not carried out to regions at which the partition walls 41 are not present at both end portions in the axial direction.

Further, it is preferable to widely constitute a region at which the supply is not carried out up to the upstream side of the notched portion of the partition wall 41 on the downstream side of the auger 36*b* such that the supply toner 21 is agitated with the developer and thereafter carried to the auger 36*a*. According to the embodiment, relative to a width of 540 mm of the agitating mechanism portion 34, L1 is set as L1=450 mm. The supply roller 38 is arranged in parallel with the augers 36*a*, 36*b*.

At the agitating mechanism portion 34, the developer 20 is agitated while being moved in the front and rear direction of the drawing by rotating the augers 36*a*, 36*b*. According to the embodiment, the auger 36*a* is rotated in the clockwise direction to carry the developer 20 to the depth side of the drawing, the developer 20 is made to flow to the side of the auger 36*b* at an end portion of the developing apparatus, not illustrated, and the auger 36*b* is rotated in the counter clockwise direction to carry the developer 20 to the front side.

The toner concentration sensor 45 provided at inside of the agitating mechanism portion 34 always detects the toner concentration value Tc of the developer 20 carried by the auger 36*b*, the detected value is compared with the reference value when the developer having the rectified toner concentration is carried by a toner concentration control circuit, not illustrated, and when the toner concentration is determined to be low, the toner 21 is supplied from the toner hopper 39 to the agitating mechanism portion 34 by rotating the supply roller 38 for a rectified period of time by instruction from the toner concentration control circuit.

According to the embodiment, the supply time period and the pause time period time are set as Tr=0.5 s, Tint=0.2 s.

FIG. 6 summarizes respective conditions of embodiments of the invention and a comparative example. As shown in FIG. 6, in the case of the Embodiment 1, the mixing limit toner concentration Tmax is set to 6.00%, the developer amount W (per 1 block) carried by 1 pitch of the auger 36*b* constituting the carrying member is set to 35.56 g, and the toner amount supplied by 1 pitch during a time period in which the developer carried by 1 pitch passes the supply region by the supply roller (total toner amount supplied to 1 block) M is set to 0.94 g, and the developer toner concentration Tc detected by the toner concentration sensor is set to 3.50%. Therefore, a value of $(W\times(Tc/100)+M)/(W+M)$ in Equation (1), mentioned above, becomes 0.0599 (the toner concentration is 5.99% at the outlet portion of the auger 36*b* after supplied with the toner) and is designed to be smaller than 0.0600 of Tmax/100.

The embodiment is constituted such that when the developer 20 having the concentration which is reduced to 3.5% in comparison with the reference value 4% of the toner concentration reaches the agitating mechanism portion 34, the toner concentration is increased to 5.99% by supplying the toner and the toner is carried from the auger 36*b* to the auger 36*a*.

The developer used in the embodiment is constituted by mixing a ferrite carrier coated with silicone having a volume average particle size of 90 μm and a styrene acryl toner having a volume average particle size of 8 μm and the fixing limit toner concentration (Tmax) is 6%.

By setting the toner concentration at the outlet portion of the auger 36*b* for mixing to agitate the supplied toner 21 in this way to be equal to or smaller than the mixing limit toner concentration, the toner can be restrained from being scattered without floating excess toner on the surface of the developer by the developer 20 carried from the agitating mechanism portion 34.

According to Comparative Example 1 having conditions the same as those of Embodiment 1 except that the rotational number Rr of the auger 36*b* is changed from 1.666 ($s^{-1}$) to 1.333 ($s^{-1}$) by the same developing apparatus, despite the fact that since the flow rate of the toner 21 included in the developer 20 and carried from the auger 36*b* is reduced to 3.12 (g/s) relative to 3.55 (g/s) of Embodiment 1, in being merged with other flow at the carry roller 35 to average the toner concentration, the toner concentration cannot be recovered to the set value, the toner concentration at the outlet portion of the auger 36*b* after having been supplied with the toner becomes 6.6% to exceed the mixing limit toner concentration and therefore, when the toner is continued to supply, the excess toner is accumulated on the surface and the toner is scattered significantly.

EXAMPLE 2

This is an example of setting the pitch of the auger 36*b* to 24 mm and otherwise, the example is the same as Example 1.

According to the example, the toner concentration at the outlet portion of the auger 36*b* is 5.86% to be lower than the mixing limit toner concentration, further, the flow rate of the toner 21 included in the developer 20 and carried from the auger 36*b* is increased from 3.55 (g/s) of Example 1 to 4.17 (g/s). As a result, the toner concentration at inside of the developing apparatus 4 can be made to be equal to or larger than the specified value more fastly to be able to deal with printing consuming a larger amount of the toner. In the case of the example, the value of (W×(Tc/100)+M)/(W+M) of Equation (1), mentioned above, becomes 0.0586 (the toner concentration at the outlet portion of the auger 36 after having been supplied with toner is 5.86%) and is designed to be smaller than 0.0600 of Tmax/100.

EXAMPLE 3

This is an example of increasing the amount of the developer at the portion of the auger 36*b*. By increasing the developer amount at the auger portion to 1000 g, despite conditions similar to those of Comparative Example 2 otherwise, the toner concentration at the outlet portion of the auger 36*b* is 5.99% to be improved equivalent to Example 1, further, the flow rate of the toner 21 included in the developer 20 and carried from the auger 36*b* is 3.55 (g/s) to be improved equivalent to Example 1. The value of (W×(Tc/100)+M)/(W+M) of Equation (1), mentioned above, becomes 0.0599 (the toner concentration at the outlet portion of the auger 36*b* after having been supplied with the toner becomes 5.99%) and is designed to be smaller than 0.0600 of Tmax/100.

EXAMPLE 4

This is a constitution similar to Example 1 except that as shown by FIG. 7, the rotational number of the auger 36*b* is made to be able to be changed by the toner concentration detected by the toner concentration sensor 45 and the supply amount per 1 rotation of the supply roller 38 is set to 2.5 (g).

The toner concentration at the outlet portion of the auger 36*b* is 5.86% to be equal to or smaller than the mixing limit toner concentration, further, the flow rate of the toner 21 included in the developer 20 and carried from the auger 36*b* can be increased more than Example 1 to be 4.17 (g/s).

Although a load on the developer 20 is increased by increasing the auger rotational number and the service life of the developer 20 is shortened, according to the example, as shown by FIG. 7, by selectively increasing the rotational number of the auger 36*b* only when the toner is consumed by a large amount by switching a rotational time period and a pause time period of the supply roller 38 and the rotational number of the auger 36*b* in accordance with the detected value of the toner concentration sensor 45, even in printing having a large toner consuming amount, high quality printing can be carried out without scattering the toner and without hardly changing the load on the developer 20.

Although an explanation has been given by using the examples including the agitating mechanism portion having two pieces of the augers, the toner supply portion having the notched supply roller and the toner concentration sensor at the auger portion, the invention is not limited thereto but a similar effect is achieved when the invention is constituted such that Equation (1) is satisfied in the developing apparatus 4 including at least the agitating mechanism portion 34 for carrying the developer 20 and the toner supply portion for supplying the toner 21 into the carried developer 20, in a developing apparatus in which the flow of passing the toner supply portion and the flow which does not pass the toner supply portion are present in a flow of the developer in the developing apparatus even in a system of measuring a toner amount after development on the sensitive member or an intermediate transferring member or the like to supply the toner without depending on a number of pieces of the augers, the mechanism of supplying the toner, positions or a number of pieces of the toner concentration sensors.

What is claimed is:

1. A developing apparatus comprising:

a supply roller supplying a toner;

an agitating mechanism portion which is supplied with the toner from the supply roller and includes a carrying member agitating to mix a developer and the toner while carrying the developer in an axial direction of the agitating mechanism portion; and a toner concentration sensor detecting a concentration of the toner in the developer, wherein the supply roller and the carrying member are arranged substantially in parallel with each other, and a flow of the developer includes a flow of passing the agitating mechanism portion and a flow which does not pass the agitating mechanism portion; and the developing apparatus satisfies the following equation:

$$(W\times(Tc/100)+M)/(W+M)\leqq T\max/100$$

where

W is an amount (g) of the developer carried by 1 pitch of the carrying member;

M is an amount (g) of the toner supplied to the 1 pitch of the carrying member during a time period in which the developer carried by the 1 pitch passes a supply region by the supply roller;

Tc is a concentration (%) of the toner in the developer detected by the toner concentration sensor; and Tmax is a mixing limit toner concentration (%).

2. The developing apparatus according to claim 1, wherein at least one of an amount of supplying the toner and a speed of carrying the developer by the carrying member can be changed in accordance with a detected value of the toner concentration sensor.

3. The developing apparatus according to claim 1, further comprising:

a first developing roller disposed upstream in a direction of rotating a photosensitive member and carrying the developer in an opposite direction of rotating the photosensitive member; and a second developing roller disposed downstream in the direction of rotating the photosensitive member and carrying the developer in the direction of rotating the photosensitive member, wherein the flow of the developer passing the agitating mechanism portion is formed by the first developing roller, the flow of the developer which does not pass the agitating mechanism portion is formed by the second developing roller, and the developer is carried to between the first developing roller and the second developing roller.

4. An electrostatic recording apparatus comprising:

a photosensitive member;

a charging unit charging a surface of the photosensitive member;

an exposing unit exposing the surface of the photosensitive body to form an electrostatic latent image in accordance with an image information;

a developing unit developing the electrostatic latent image with a toner to form a toner image on the surface of the photosensitive member; and a transferring unit transferring the toner image to a transfer member, wherein the developing unit comprising:

a supply roller supplying a toner;

an agitating mechanism portion which is supplied with the toner from the supply roller and includes a carrying member agitating to mix a developer and the toner while carrying the developer in an axial direction of the agitating mechanism portion; and a toner concentration sensor detecting a concentration of the toner in the developer, wherein the supply roller and the carrying member are arranged substantially in parallel with each other, and a flow of the developer includes a flow of passing the agitating mechanism portion and a flow which does not pass the agitating mechanism portion; and the developing apparatus satisfies the following equation:

$$(W\times(Tc/100)+M)/(W+M)\leqq T\max/100$$

where

W is an amount (g) of the developer carried by 1 pitch of the carrying member;

M is an amount (g) of the toner supplied to the 1 pitch of the carrying member during a time period in which the developer carried by the 1 pitch passes a supply region by the supply roller;

Tc is a concentration of the toner in the developer detected by the toner concentration (%) sensor; and Tmax is a mixing limit toner concentration (%).

* * * * *